US007619586B2

(12) United States Patent
Moon

(10) Patent No.: US 7,619,586 B2
(45) Date of Patent: Nov. 17, 2009

(54) PLASMA DISPLAY APPARATUS AND METHOD FOR DRIVING THE SAME

(75) Inventor: Seong Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 382 days.

(21) Appl. No.: 11/102,238

(22) Filed: Apr. 7, 2005

(65) Prior Publication Data

US 2005/0225506 A1 Oct. 13, 2005

(30) Foreign Application Priority Data

Apr. 9, 2004 (KR) ..... 10-2004-0024559

(51) Int. Cl.
*G09G 3/28* (2006.01)

(52) U.S. Cl. ..... 345/60; 345/68; 315/169.4

(58) Field of Classification Search ..... 345/60–69, 345/71–72, 37, 41–42; 315/169.4
See application file for complete search history.

(56) References Cited

U.S. PATENT DOCUMENTS 5,835,072 A * 11/1998 Kanazawa ..... 345/60
6,252,568 B1 * 6/2001 Iseki et al. ..... 345/60
6,256,001 B1 * 7/2001 Kim et al. ..... 345/60
6,573,878 B1 * 6/2003 Mizobata ..... 345/60
6,624,587 B2 * 9/2003 Kim ..... 315/169.1
6,642,912 B2 * 11/2003 Furutani ..... 345/68
6,707,436 B2 * 3/2004 Setoguchi et al. ..... 345/60
7,427,969 B2 * 9/2008 Sasaki et al. ..... 345/60
7,436,375 B2 * 10/2008 Hirakawa et al. ..... 345/60
2002/0047584 A1 4/2002 Rutherford
2002/0105278 A1 8/2002 Kanazawa
2002/0140639 A1 * 10/2002 Sakita ..... 345/60
2004/0021622 A1 * 2/2004 Nagao et al. ..... 345/60
2005/0116885 A1 * 6/2005 Sasaki et al. ..... 345/60

(Continued)

FOREIGN PATENT DOCUMENTS

CN 1368717 9/2002

(Continued)

*Primary Examiner*—Alexander Eisen
*Assistant Examiner*—Jason M Mandeville
(74) *Attorney, Agent, or Firm*—Lee, Hong, Degerman, Kang & Waimey

(57) ABSTRACT

The present invention relates to a plasma display apparatus and method for driving the same. According to the present invention, the plasma display apparatus includes a plasma display panel having a first electrode and a second electrode, and a third electrode which is crossed with the first electrode and the second electrode, a scan driving unit for applying a sustain pulse, which rises from a first bias voltage of the negative polarity up to a sustain voltage, to the first electrode, and a sustain driving unit for applying a sustain pulse, which rises from a second bias voltage of the negative polarity up to a sustain voltage, to the second electrode in an alternate manner with the sustain pulse applied by the scan driving unit. Further, in the method for driving the plasma display apparatus, when a driving pulse is applied to first, second and third electrodes in a reset period, an address period and a sustain period, and an image is displayed with frames by a combination of one or more sub-fields, in the sustain period, a sustain pulse that rises from a first bias voltage of the negative polarity up to a sustain voltage is applied to the first electrode, and a sustain pulse that rises from a second bias voltage of the negative polarity up to a sustain voltage is applied to the second electrode in an alternate manner with the sustain pulse that rises from the first bias voltage of the negative polarity up to the sustain voltage.

12 Claims, 7 Drawing Sheets

U.S. PATENT DOCUMENTS

2005/0195135 A1* 9/2005 Moon ..... 345/67

FOREIGN PATENT DOCUMENTS

EP 1030286 A2 * 8/2000
JP 10039827 A * 2/1998
JP 2000-194316 7/2000
WO WO 0182282 A1 11/2001

* cited by examiner

PLASMA DISPLAY APPARATUS AND METHOD FOR DRIVING THE SAME

CROSS-REFERENCES TO RELATED APPLICATIONS

This Nonprovisional application claims priority under 35 U.S.C. § 119(a) on Patent Application No. 10-2004-0024559 filed in Korea on Apr. 9, 2004, the entire contents of which are hereby incorporated by reference.

BACKGROUND OF THE INVENTION

1. Field of the Invention

The present invention relates to a plasma display apparatus and method for driving the same.

2. Background of the Related Art

Generally, a plasma display panel (hereinafter, referred to as a "PDP") is adapted to display an image including characters or graphics by light-emitting phosphors with ultraviolet of 147 nm generating during discharging of an inert mixed gas such as He+Xe or Ne+Xe.

FIG. 1 is a perspective view illustrating the construction of a conventional three-electrode AC surface discharge type PDP having a discharge cell structure arranged in the matrix form.

Referring to FIG. 1, the three-electrode AC surface discharge type PDP 100 includes a scan electrode 11*a* and a sustain electrode 12*a* formed on a bottom surface of an upper substrate 10, and an address electrode 22 formed on a top surface of a lower substrate 20. The scan electrode 11*a* and the sustain electrode 12*a* are formed using a transparent electrode, for example, indium-tin-oxide (ITO). Metal bus electrodes 11*b*, 12*b* for reducing resistance are formed in the scan electrode 11*a* and the sustain electrode 12*a*, respectively. On the bottom surface of the upper substrate 10 in which the scan electrodes 11*a* and the sustain electrode 12*a* are formed are laminated an upper dielectric layer 13*a* and a protective layer 14. The upper dielectric layer 13*a* is accumulated with a wall charge generated during plasma discharging. The protective layer 14 is adapted to prevent damages of the upper dielectric layer 13*a* due to sputtering caused during the plasma discharging, and improve the efficiency of secondary electron emission. As the protective layer 14, magnesium oxide (MgO) is generally used.

Meanwhile, a lower dielectric layer 13*b* and barrier ribs 21 are formed on the lower substrate 20 in which the address electrode 22 is formed. A phosphor layer 23 is coated on the surfaces of both the lower dielectric layer 23*b* and the barrier ribs 21. The address electrode 22 is formed in a direction where it intersects the scan electrode 11*a* and the sustain electrode 12*a*. The barrier ribs 21 are formed in parallel to the address electrode 22, and serves to prevent leakage of an ultraviolet and a visible light generated by discharging to neighboring discharge cells. A phosphor layer 23 is excited with an ultraviolet generated during plasma discharging to generate any one of red (R), green (G) and blue (B) visible light. An inert mixed gas such as He+Xe or Ne+Xe is injected into discharge spaces of discharge cells, which are defined by the barrier ribs 21 between the upper substrate 10 and the lower substrate 20. A method for driving the conventional PDP constructed above will now be described with reference to FIG. 2.

FIG. 2 shows a driving waveform for explaining a method for driving the conventional PDP. Referring to FIG. 2, the conventional PDP is driven with be being divided into a reset period for initializing the entire screen, an address period for selecting a cell, and a sustain period for sustaining discharge of a selected cell.

First, the reset period is driven with it being divided into a set-up period SU and a set-down period SD. In the set-up period SU, a ramp-up waveform Ramp-up is applied to all scan electrodes Y at the same time. Discharging is generated within cells of the entire screen by means of the ramp-up waveform. This set-up discharge causes wall charges of the positive polarity to be accumulated on the address electrode X and the sustain electrode Z, and wall charges of the negative polarity to be accumulated on the scan electrode Y. In the set-down period SD, after the ramp-up waveform is supplied, a ramp-down waveform Ramp-down, which drops from a positive voltage lower than a peak voltage of the ramp-up waveform to a ground voltage GND or a predetermined negative voltage level, causes a weak erase discharge to occur within the cells, thereby erasing some of wall charges that are excessively formed. This set-down discharge causes wall charges of the extent that an address discharge can be generated stably to uniformly remain within the cells.

In the address period, while a negative scan pulse SCAN is sequentially applied to the scan electrodes Y, a positive data pulse data is applied to the address electrodes X in synchronization with the scan pulse. As a voltage difference between the scan pulse and the data pulse and a wall voltage formed in the reset period are added, an address discharge is generated within cells to which the data pulse is applied. The address discharge causes wall charges of the extent, which can generate discharging when a sustain voltage is applied, to be formed within a selected cell. To the sustain electrode Z is applied a positive DC voltage Zdc so that erroneous discharge with the scan electrodes Y is not generated through reduction of a voltage difference with the scan electrodes Y during the set-down period and the address period.

In the sustain period, a sustain pulse SUS is alternately applied to the scan electrodes Y and the sustain electrodes Z. A sustain discharge, i.e., a display discharge is generated between the scan electrodes Y and the sustain electrodes Z of a cell selected by the address discharge whenever the sustain pulse is applied as the wall voltage within the cell and the sustain pulse are added. Further, after the sustain discharge is completed, a ramp waveform Ramp-ers having a narrow pulse width and a low voltage level is supplied to the sustain electrodes Z, thereby erasing wall charges remaining within cells of the entire screen.

On the other hand, the operation of the driving apparatus of the PDP in the address period and the sustain period will be below described in more detail with reference to FIGS. 3 and 4.

FIG. 3 is a circuit diagram for explaining a driving apparatus that operates in the address period and the sustain period of the conventional PDP. FIG. 4 shows waveforms of a scan pulse and a sustain pulse in the prior art.

As shown in FIGS. 3 and 4, if a Y1 electrode is selected in the address period, two switching elements 211-1,213-1 included in a scan driver 210-1 corresponding to the Y1 electrode, A switching element 220 for scan and a switching element 230 for bias are turned on. At the same time, switching elements 211-2 to 211-n located at the top, among two switching elements included in scan drivers 210-2 to 210-n corresponding to remaining Y electrodes Y2 to Yn that are not selected, are turned on, and switching elements 213-2 to 213-n located at the bottom are turned off.

Accordingly, a scan pulse voltage applied to selected Y electrodes varies between a bias voltage—Vbias and a scan voltage—Vyscan, and the potential of Y electrodes that are not selected becomes a bias voltage—Vbias.

Furthermore, in order for a sustain pulse to be applied to the Y electrodes in the sustain period, the switching elements 211-1 to 211-n, 213-1 to 213-n included in the scan drivers 210-1 to 210-n, the switching element 220 for scan and the switching element 230 for bias are all turned off, and a switching element 240 for sustain and a switching element 260 for ground are turned on. Accordingly, a voltage Vsy is applied to the Y electrodes through a diode located on a lower side of the scan drivers 210-1 to 210-n.

Furthermore, in order for a sustain pulse to be applied to the Z electrodes in the sustain period, the switching element 250 for sustain and the switching element 230 for bias are turned on, and switching elements included in the scan drivers 210-1 to 210-n, the switching element 220 for scan and the switching element 240 for sustain are turned off. As such, a voltage Vsz is applied to the Z electrodes.

In case of the prior art, since the voltage level of the sustain pulse applied to the Y electrodes and the Z electrodes in the sustain period varies from OV to Vsy or Vsz, the X electrodes being a data electrode are always charged with positive ions. As such, in the process where the X electrodes are charged with positive ions, the positive ions collide against phosphors, which shortens the lifespan of phosphors. Moreover, as particles generated by collision of the positive ions are adhered on the surface, they degrade brightness. This is because the shock of a case where positive ions collide against phosphors is over several thousands of times stronger than a case where negative ions collide against phosphors since the mass of the positive ions is very higher than that of the negative ions.

Further, the voltage level of the Z electrodes in the address period is a ground level, and the voltage level of the Y electrode is a bias voltage—Vbias. As a bias voltage as much as a predetermined voltage is applied from the Z electrodes to the Y electrodes, a voltage difference occurs. This voltage difference always serves as leakage to increase power consumption, and also has a bad influence on the operation of a driving apparatus.

In addition, since the bias voltage—Vbias in the address period and the bias voltage being the ground level in the sustain period are different from each other, a circuit of the driving apparatus is complicated, and is influenced by noise.

SUMMARY OF THE INVENTION

Accordingly, the present invention has been made in view of the above problems occurring in the prior art, and it is an object of the present invention to provide a plasma display apparatus in which address electrodes are charged with positive ions in a sustain period while a PDP operates, thus preventing shortening in the lifespan of the panel depending upon damages given to phosphors, and method for driving the same.

Another object of the present invention is to provide a plasma display apparatus in which an increase of power consumption caused by the leakage action due to a voltage difference between scan electrodes and sustain electrodes in an address period while a PDP operates can be prevented, and method for driving the same.

To achieve the above object, according to an aspect of the present invention, there is provided a plasma display apparatus, including a plasma display panel having a scan electrode and a sustain electrode, and an address electrode crossed with the scan electrode and the sustain electrode, a scan driving unit for applying a sustain pulse, which rises from a first bias voltage of the negative polarity up to a sustain voltage, to the scan electrode, and a sustain driving unit for applying a sustain pulse, which rises from a second bias voltage of the negative polarity up to a sustain voltage, to the sustain electrode in an alternate manner with the sustain pulse applied by the scan driving unit.

According to another aspect of the present invention, there is provided a method for driving a plasma display apparatus including a scan driver in which a driving pulse is applied to a scan electrode, a sustain electrode and an address electrode of a plasma display panel in a reset period, an address period and a sustain period, and an image is displayed with frames by a combination of one or more sub-fields, wherein in the sustain period, a sustain pulse that rises from a first bias voltage of the negative polarity up to a sustain voltage is applied to the scan electrode, and a sustain pulse that rises from a second bias voltage of the negative polarity up to a sustain voltage is applied to the sustain electrode in an alternate manner with the sustain pulse that rises from the first bias voltage of the negative polarity up to the sustain voltage.

BRIEF DESCRIPTION OF THE DRAWINGS

Further objects and advantages of the invention can be more fully understood from the following detailed description taken in conjunction with the accompanying drawings in which.

DETAILED DESCRIPTION OF THE PREFERRED EMBODIMENT

The present invention will now be described in detail in connection with preferred embodiments with reference to the accompanying drawings.

Figure 1:
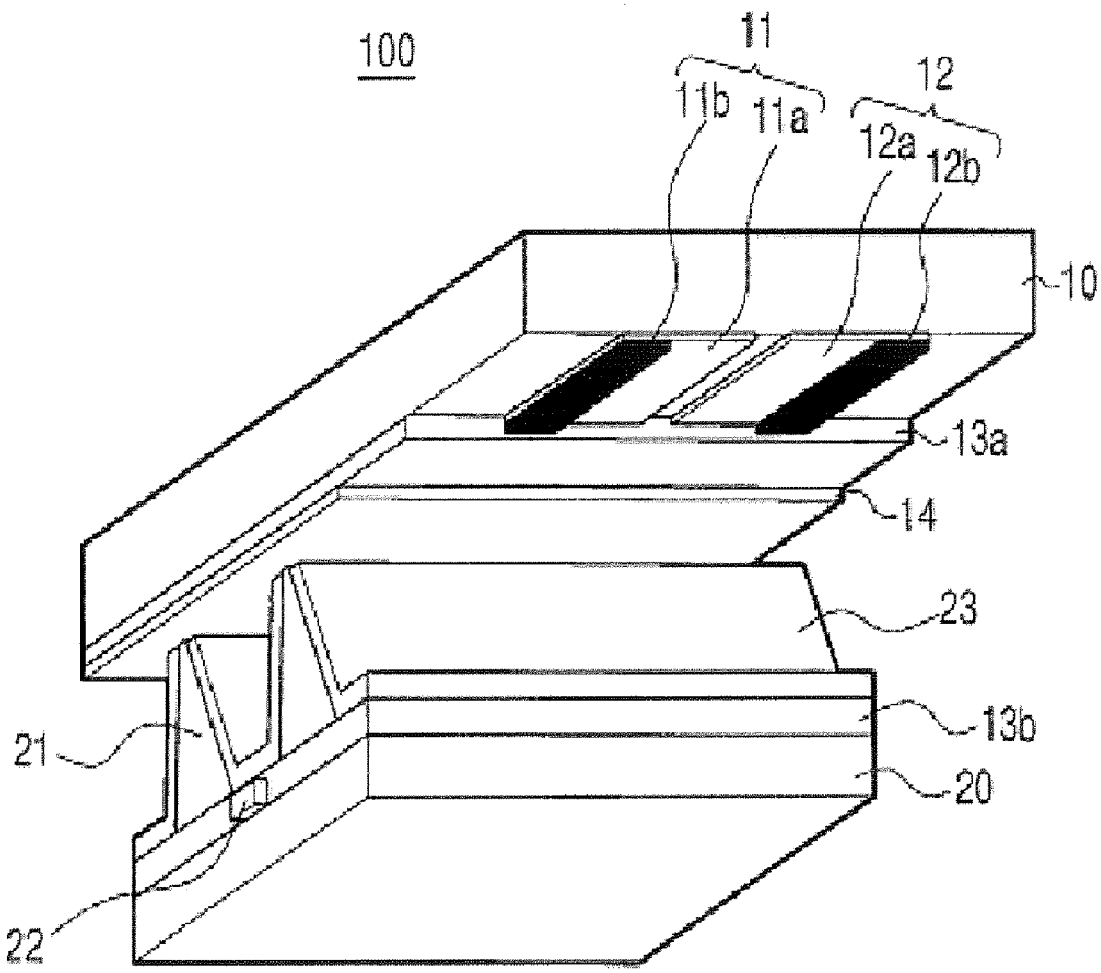
Fig. 1 (Prior Art)
FIG. 1 is a perspective view illustrating the construction of a conventional three-electrode AC surface discharge type PDP having a discharge cell structure arranged in the matrix form.
Figure 2:
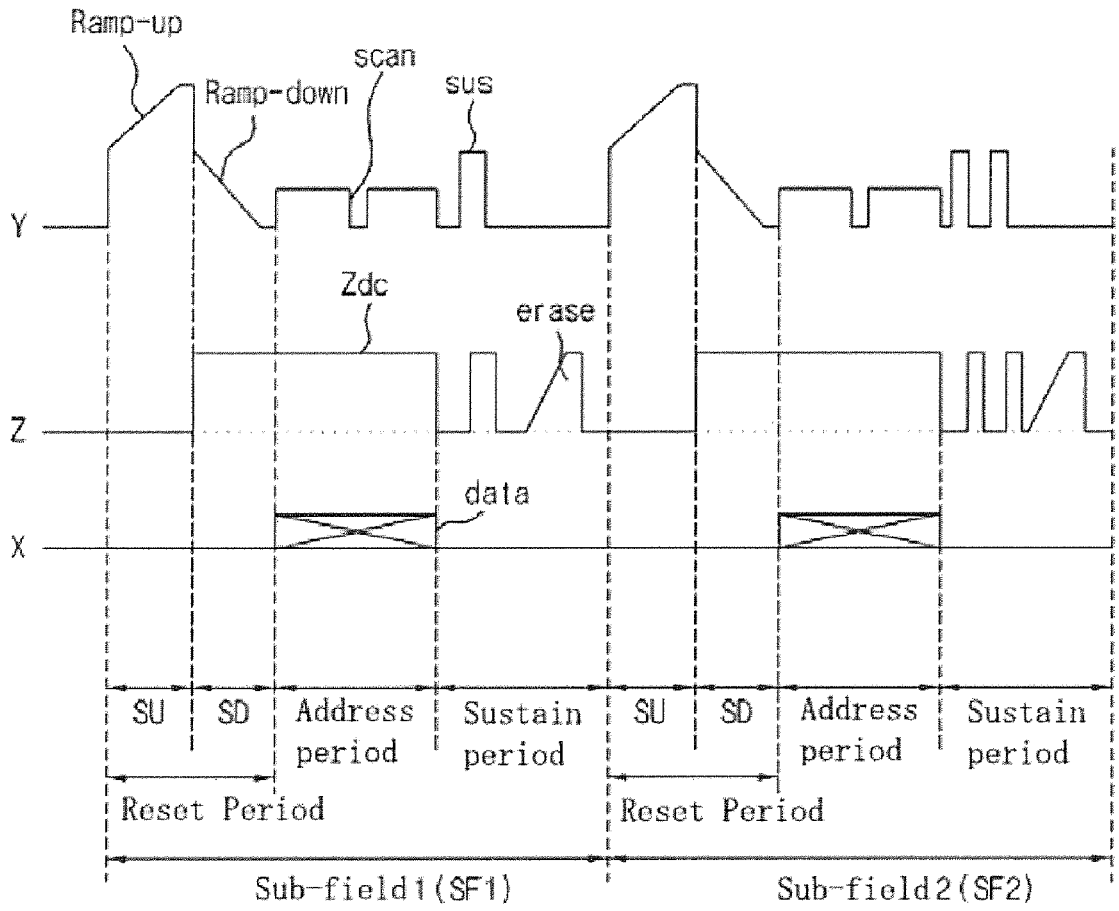
Fig. 2 (Prior Art)
FIG. 2 shows a driving waveform for explaining a method for driving the conventional PDP.
Figure 3:
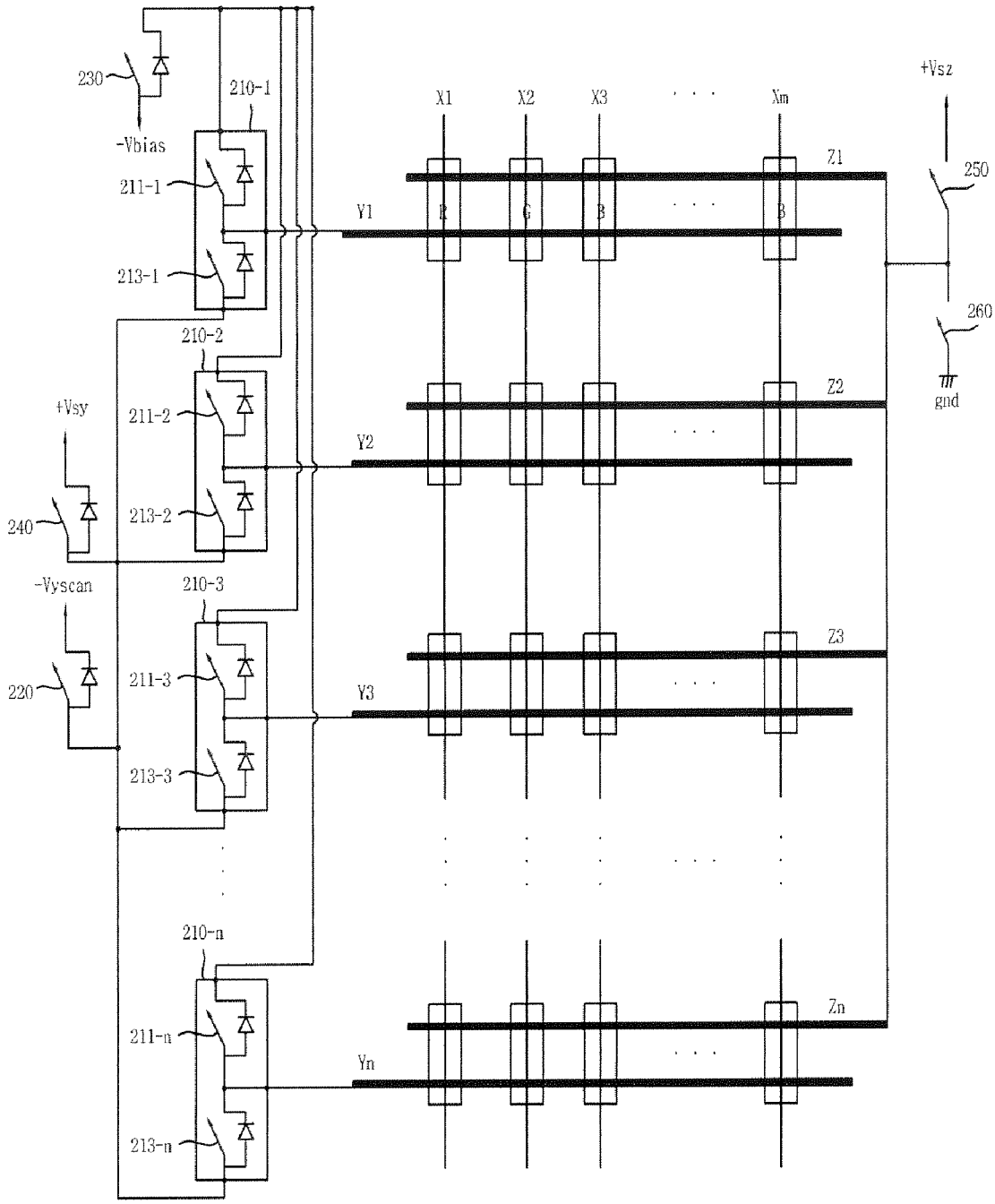
Fig. 3 (Prior Art)
FIG. 3 is a circuit diagram for explaining a driving apparatus that operates in the address period and the sustain period of the conventional PDP.
Figure 4:
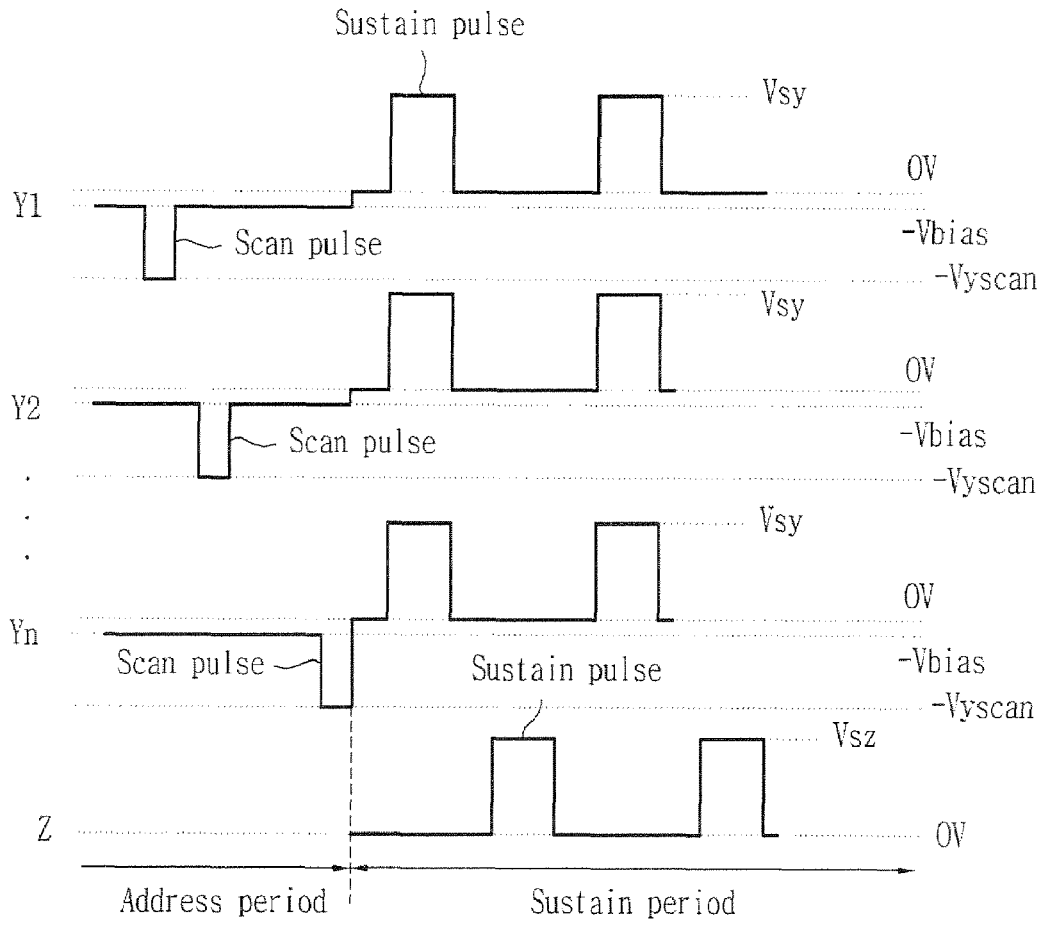
Fig. 4 (Prior Art)
FIG. 4 shows waveforms of a scan pulse and a sustain pulse in the prior art.
Figure 5:
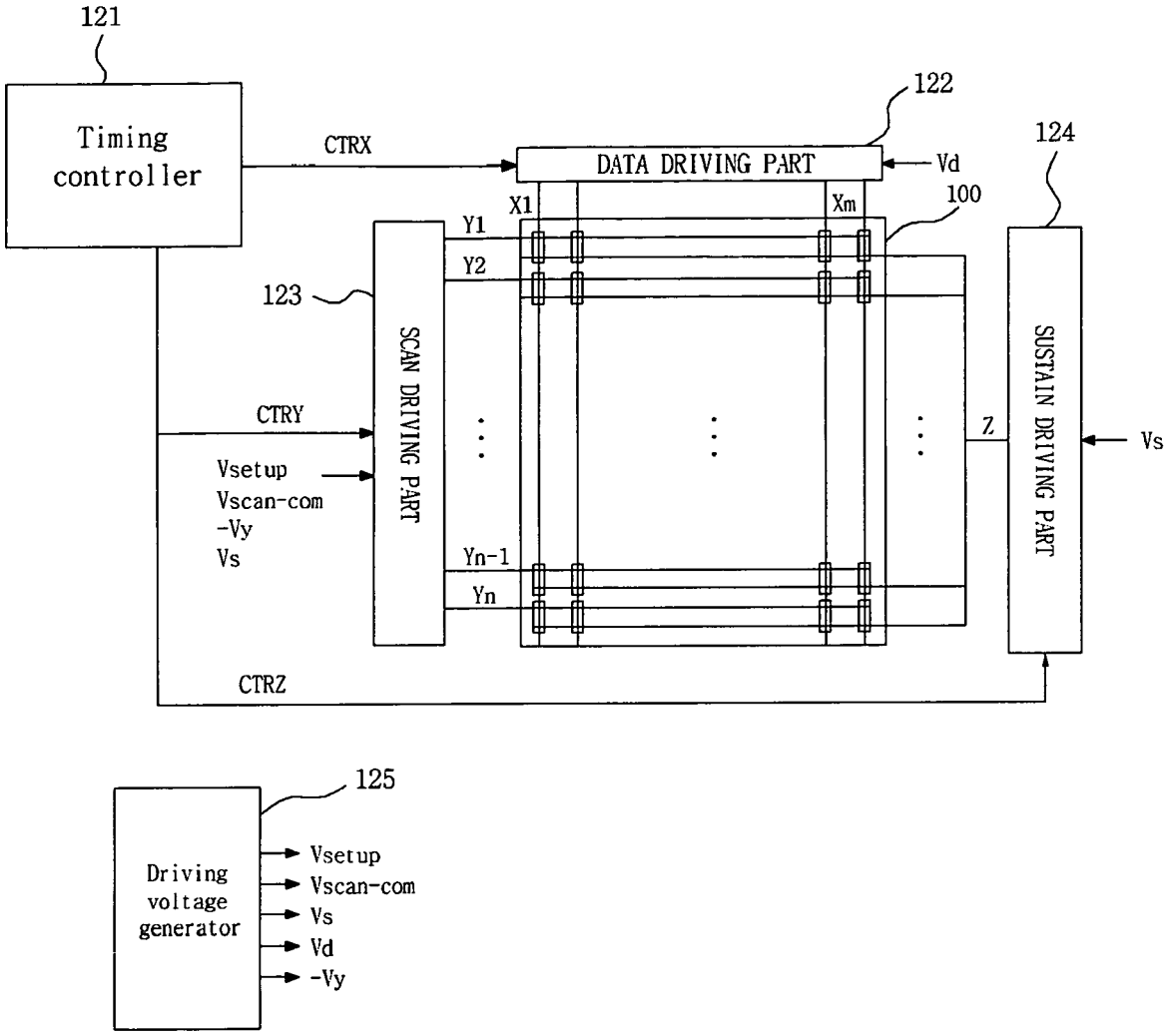
FIG. 5 is a diagram showing a plasma display apparatus according to the present invention.

FIG. 5 is a diagram showing a plasma display apparatus according to the present invention.

Referring to FIG. 5, the plasma display apparatus according to the present invention includes a PDP 100, a data driving unit 122 for supplying data to address electrodes X1 to Xm formed in a lower substrate (not shown) of the PDP 100, a scan driving unit 123 for driving scan electrodes Y1 to Yn, a sustain driving unit 124 for driving a sustain electrodes Z being a common electrode, a timing controller 121 for controlling the data driving unit 122, the scan driving unit 123 and the sustain driving unit 124 when the PDP is driven, and a driving voltage generator 125 for supplying driving voltages necessary for the driving units 122, 123 and 124.

The PDP 100 has an upper substrate (not shown) and a lower substrate (not shown), which are combined together with a predetermined gap therebetween. A number of electrodes, e.g., scan electrodes Y1 to Yn and sustain electrodes Z are also formed in pairs in the upper substrate, and address electrodes X1 to Xm are formed in the lower substrate in such a way to cross the scan electrodes Y1 to Yn and the sustain electrode Z.

The data driving unit 122 are supplied with data, which have experienced inverse gamma correction and error diffusion through an inverse gamma correction circuit, an error diffusion circuit, etc., and are then mapped to respective sub-fields by means of a sub-field mapping circuit. The data driving unit 122 samples and latches data in response to a data timing control signal CTRX from the timing controller 121, and supplies the data to the address electrodes X1 to Xm.

The scan driving unit 123 provide a ramp-up waveform Ramp-up and a ramp-down waveform Ramp-down to the scan electrodes Y1 to Yn during the reset period under the control of the timing controller 121. The scan driving unit 123 also supplies a scan pulse Sp of a scan voltage—Vy to the scan electrodes Y1 to Yn, in a sequential manner, during the address period under the control of the timing controller 121, and applies a sustain pulse, which rises from a first bias voltage to a sustain voltage, to the scan electrodes Y1 to Yn during the sustain period. In this case, the first bias voltage has a negative voltage.

The sustain driving unit 124 alternately operates with the scan driving unit 123 during the sustain period under the control of the timing controller 121 to supply a sustain pulse SUS that rises from a second bias voltage to the sustain voltage to the sustain electrodes Z.

The timing controller 121 receives a vertical/horizontal sync signal and a clock signal, and generates timing control signals CTRX, CTRY and CTRZ for controlling operational timing and synchronization of the respective driving units 122, 123, 124 and the sustain pulse controller 126 in the reset period, the address period and the sustain period. The timing controller 121 controls the respective driving units 122, 123 and 124 by applying the timing control signals CTRX, CTRY and CTRZ to corresponding driving units 122, 123 and 124.

Meanwhile, the data control signal CTRX includes a sampling clock for sampling data, a latch control signal, and a switch control signal for controlling on/off time of an energy recovery circuit and a driving switch element. The scan control signal CTRY includes a switch control signal for controlling on/off time of an energy recovery circuit and a driving switch element within the scan driving unit 123. The sustain control signal CTRZ includes a switch control signal for controlling on/off time of an energy recovery circuit and a driving switch element within the sustain driving unit 124.

The driving voltage generator 125 generates a set-up voltage Vsetup, a scan-common voltage Vscan-com, a scan voltage—Vy, a sustain voltage Vs, a data voltage Vd, and the like. These driving voltages can vary according to the composition of a discharge gas, or a discharge cell structure.

The operating principle of the plasma display apparatus constructed above according to the present invention in the address period and the sustain period will now be described with reference to FIGS. 6 and 7.

Figure 6:
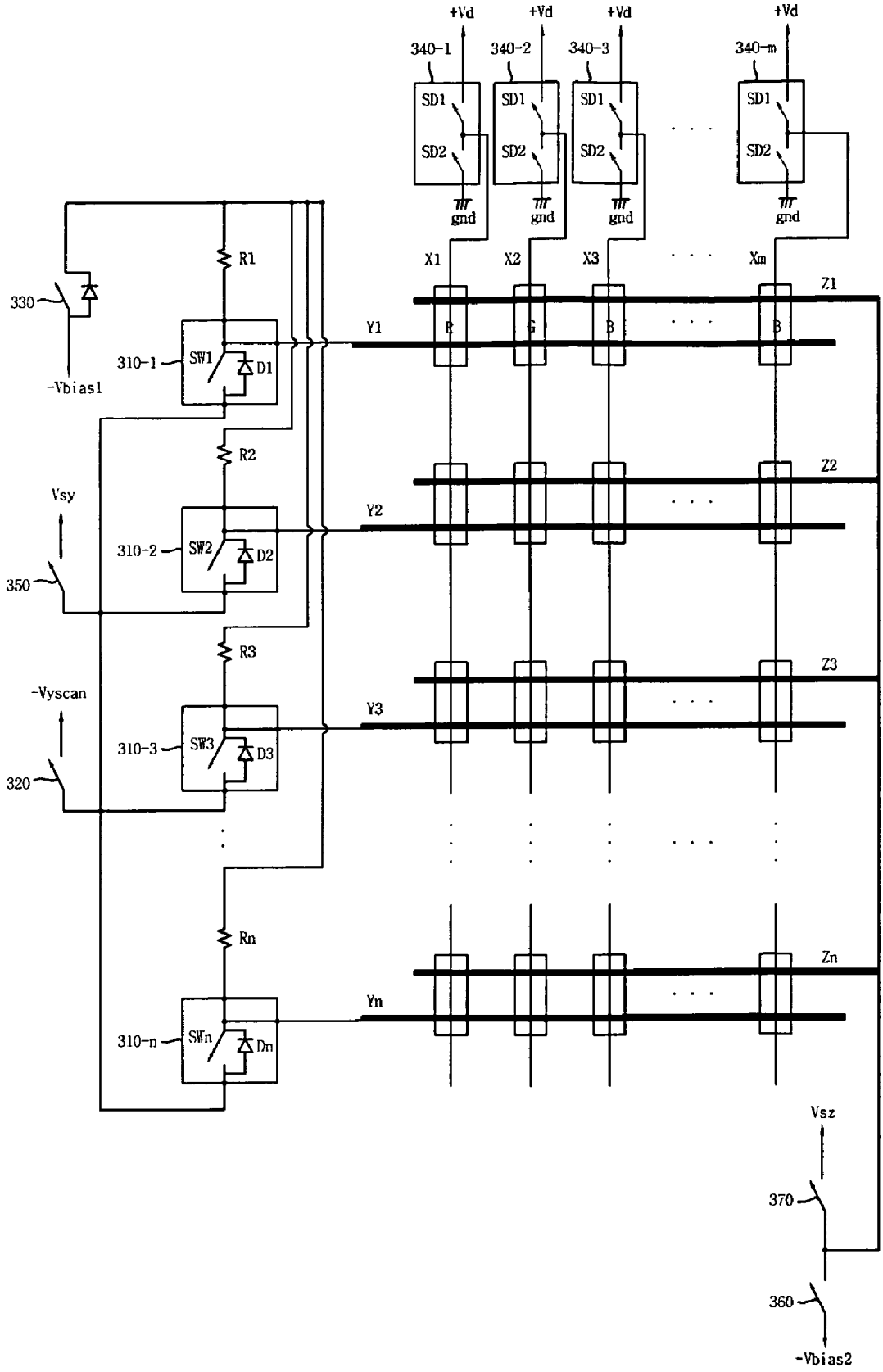
FIG. 6 is a circuit diagram showing a driving unit of the plasma display apparatus according to the present invention.

FIG. 6 is a circuit diagram showing a driving unit of the plasma display apparatus according to the present invention. FIG. 7 shows driving waveforms the plasma display apparatus according to the present invention. In FIGS. 6 and 7, it is first assumed that the scan pulse is applied to the Y1 electrodes in the address period.

In order for a scan pulse to be applied to a selected Y1 electrode, a switching element SW1 included in a scan driver 310-1 connected to the Y1 electrode, a switching element 320 for scan, and a switching element 330 for a first bias are turned on. In order to apply a data pulse to a selected cell, a corresponding switching element SD1 for address is turned on.

Furthermore, switching elements SW2 to SWn included in scan drivers 310-2 to 310-n connected to the remaining Y electrodes Y2 to Yn that are not selected, and a switching element 350 for a first sustain are turned off.

Figure 7:
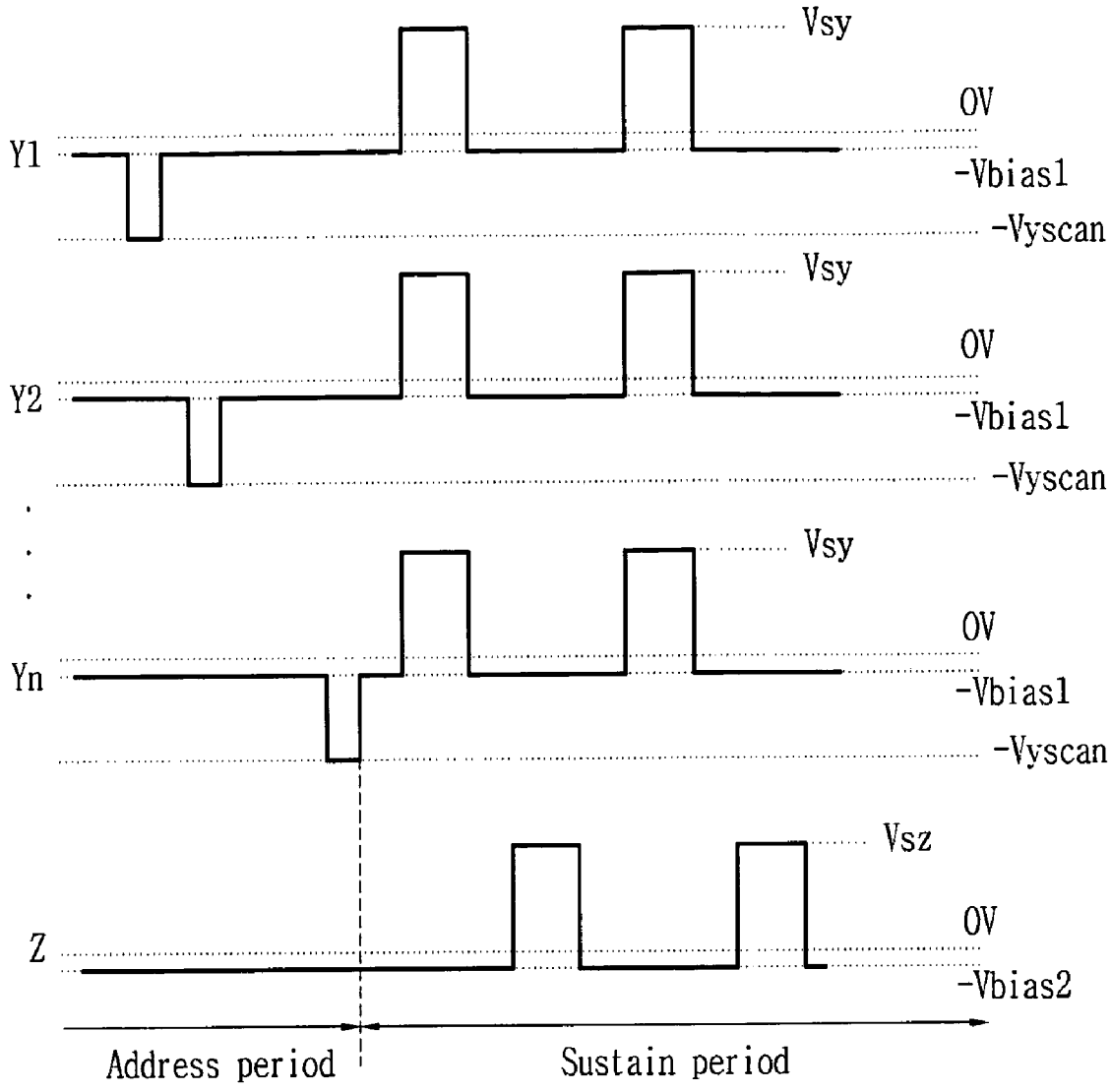
FIG. 7 shows driving waveforms the plasma display apparatus according to the present invention.

Accordingly, as shown in FIG. 7, the first bias voltage—Vbias1 and the scan voltage—Vyscan are applied to the selected Y1 electrode at the same time, and the first bias voltage—Vbias1 is applied to the remaining Y electrodes Y2 to Yn.

In this address period, the switching element 360 for a second bias is turned on, and the switching element 370 for a second sustain is turned off. Thus, as shown in FIG. 7, the second bias voltage—Vbias2 is applied to the Z electrode.

Then, in the sustain period, the switching element 350 for a first sustain, the switching elements SW1 to SWn of all the scan drivers 310-1 to 310-n, and the switching element 360 for the second bias are turned on, and the switching element 330 for a second bias and the switching element 370 for a second sustain are turned off. Accordingly, as shown in FIG. 7, the voltage of the sustain pulse applied to the Y electrode rises up to Vsy, and the voltage of the Z electrode is kept to the level of the second bias voltage—Vbias2.

Thereafter, the switching element 370 for a second sustain and the switching element 330 for a second bias are turned on, and the switching elements SW1 to SWn for all the scan drivers, the switching element 320 for scan, the switching element 350 for a second sustain and the switching element 360 for a second bias are turned off. Accordingly, as shown in FIG. 7, the voltage of the sustain pulse applied to the Z electrode rises up to Vsz, and the Y electrode is kept to the level of the first bias voltage—Vbias1.

As such, according to the operation of the driving apparatus of the PDP in accordance with the present invention the PDP, the voltage of the sustain pulse, which is applied to the Y electrodes and the Z electrodes in the sustain period, varies from the first bias voltage—Vbias1 to Vsy, or from the second bias voltage—Vbias2 to Vsz. Thus, the number of positive ions charged into the X electrodes can be reduced compared to the conventional driving apparatus in which the voltage of the sustain pulse varies starting from OV. As the number of positive ions charged into the X electrodes reduces, the lifespan of the PDP can lengthen, and reduction of brightness can be prevented.

Moreover, in the case where the first bias voltage—Vbias1 and the second bias voltage—Vbias2 have the same value, a voltage difference does not occur between Y electrodes and Z electrodes, which are not selected in the address period. Therefore, leaked power can be minimized unlike the conventional driving apparatus.

Furthermore, in the case where the first bias voltage—Vbias1 and the second bias voltage—Vbias2 have the same value, in the driving apparatus according to the present invention, bias voltages applied to the Y electrodes and the Z electrodes in the address period have the same value. Thus, the driving apparatus can be simplified, and the influence of noise can be minimized.

As described above, according to the present invention, the number of positive ions charged into address electrodes is reduced, the lifespan of a panel lengthens, and reduction of brightness is minimized. Furthermore, as the amount of bias voltages applied to scan electrodes and sustain electrodes have the same value, the amount of power leaked can be reduced.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A plasma display apparatus, comprising:

a plasma display panel having a first electrode and a second electrode;

a scan driving unit for applying a sustain pulse to the first electrode, the first sustain pulse rising from a first bias voltage having a negative polarity up to a first sustain voltage; and a sustain driving unit for applying a second sustain pulse to the second electrode in an alternate manner with the sustain pulse applied by the scan driving unit from a second bias voltage having a negative polarity up to a second sustain voltage, wherein the first bias voltage having a negative polarity is applied to the first electrode during an address period, and the second bias voltage having a negative polarity is applied to the second electrode during the address period when the scan driving unit applies a scan pulse to the first electrode, wherein the first bias voltage having a negative polarity and the second bias voltage having a negative polarity have the same value.

2. The plasma display apparatus as claimed in claim 1, wherein the scan driving unit comprises a scan driver having one switching element connected to the first electrode of the plasma display panel, the switching element turned on when the first sustain pulse is applied to the first electrode in order to apply the first sustain voltage to the first electrode.

3. The plasma display apparatus as claimed in claim 2, wherein the second bias voltage having a negative polarity is applied to the second electrode when the switching element is turned on to apply the first sustain voltage to the first electrode.

4. The plasma display apparatus as claimed in claim 1, wherein the scan driving unit comprises a scan driver having one switching element connected to the first electrode of the plasma display panel, the switching element is turned off when the first bias voltage is applied to the first electrode and the second sustain pulse is applied to the second electrode.

5. The plasma display apparatus as claimed in claim 1, wherein the scan driving unit comprises a plurality of scan drivers each having one switching element connected to the first electrode of the plasma display panel and a scan pulse is applied to the first electrode when the switching element of one of the plurality of the scan drivers connected to the first electrode is turned on during an address period.

6. The plasma display apparatus as claimed in claim 5, wherein the switching element of the scan driver connected to a first electrode that is not selected is turned off, and the first bias voltage is applied to the first electrode that is not selected.

7. The plasma display apparatus as claimed in claim 1, wherein the second bias voltage having a negative polarity is applied to the second electrode when the scan driving unit applies the scan pulse to the first electrode.

8. A method for driving a plasma display apparatus including a first electrode and a second electrode, the method comprising:

applying a first sustain pulse to the first electrode, the first sustain pulse rising from a first bias voltage having a negative polarity up to a first sustain voltage; and applying a second sustain pulse to the second electrode in an alternate manner with the first sustain pulse, the second sustain pulse rising from a second bias voltage having a negative polarity up to a second sustain voltage, wherein the first bias voltage having a negative polarity is applied to the first electrode during an address period, and a second bias voltage having the negative polarity is applied to the second electrode during the address period when a scan driving unit applies a scan pulse to the first electrode, wherein the first bias voltage having a negative polarity and the second bias voltage having a negative polarity have the same value.

9. The method as claimed in claim 8, wherein the second bias voltage having a negative polarity is applied to the second electrode when the first sustain voltage is applied to the first electrode.

10. The method as claimed in claim 8, wherein the first bias voltage having a negative polarity is applied to the first electrode when the second sustain pulse is applied to the second electrode.

11. The method as claimed in claim 8, wherein the plasma display apparatus further includes a plurality of first electrodes and wherein the first bias voltage having a negative polarity is applied to a non-selected first electrode when the scan pulse is applied to the first electrode.

12. The method as claimed in claim 8, wherein the second bias voltage having a negative polarity is applied to the second electrode when the scan driving unit applies the scan pulse to the first electrode.

* * * * *